US006335136B1

(12) United States Patent
Pan et al.

(10) Patent No.: US 6,335,136 B1
(45) Date of Patent: Jan. 1, 2002

(54) DEVELOPER COMPOSITIONS AND PROCESSES

(75) Inventors: David H. Pan, Rochester; Christopher M. Knapp, Fairport, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/777,967

(22) Filed: Feb. 6, 2001

(51) Int. Cl.[7] ..... G03G 9/135
(52) U.S. Cl. ..... 430/108.8; 399/251
(58) Field of Search ..... 430/115, 114, 430/108.8; 399/251

(56) References Cited

U.S. PATENT DOCUMENTS

| | | | | | |
|---|---|---|---|---|---|
| 4,707,429 | A | | 11/1987 | Trout | 430/115 |
| 5,019,477 | A | | 5/1991 | Felder | 430/115 |
| 5,028,508 | A | | 7/1991 | Lane et al. | 430/115 |
| 5,030,535 | A | | 7/1991 | Drappel et al. | 430/116 |
| 5,034,299 | A | | 7/1991 | Houle et al. | 430/115 |
| 5,045,425 | A | | 9/1991 | Swidler | 430/115 |
| 5,066,821 | A | | 11/1991 | House et al. | 430/137 |
| 5,069,995 | A | | 12/1991 | Swidler | 430/115 |
| 5,223,368 | A | | 6/1993 | Ciccarelli et al. | 430/110 |
| 5,306,591 | A | | 4/1994 | Larson et al. | 430/115 |
| 5,308,731 | A | | 5/1994 | Larson et al. | 430/115 |
| 5,352,563 | A | | 10/1994 | Kawasaki et al. | 430/264 |
| 5,366,840 | A | | 11/1994 | Larson et al. | 430/115 |
| 5,409,803 | A | | 4/1995 | Santos et al. | 430/331 |
| 5,521,046 | A | * | 5/1996 | Materazzi et al. | 430/115 |
| 5,554,476 | A | * | 9/1996 | Landa et al. | 430/115 |
| 5,627,002 | A | | 5/1997 | Pan et al. | 430/115 |
| 5,826,147 | A | | 10/1998 | Liu et al. | 399/237 |

* cited by examiner

*Primary Examiner*—John Goodrow
(74) *Attorney, Agent, or Firm*—E. O. Palazzo

(57) ABSTRACT

A liquid developer containing a liquid, colorant, and a wax charge acceptance additive. When free of colorant, the developer is considered colorless or slightly colored.

28 Claims, No Drawings

DEVELOPER COMPOSITIONS AND PROCESSES

COPENDING APPLICATIONS AND PATENTS

In copending application U.S. Ser. No. 09/777,423 pending, filed concurrently herewith, the disclosure of which is totally incorporated herein by reference, there is illustrated A liquid developer comprised of a nonpolar liquid, thermoplastic resin, colorant, and a silica charge acceptance additive; U.S. Ser. No. 09/777,469 pending, filed concurrently herewith, the disclosure of which is totally incorporated herein by reference, illustrates a liquid developer comprised of a nonpolar liquid, thermoplastic resin, optional colorant, and an inorganic filler; U.S. Ser. No. 09/777,598 pending, filed concurrently herewith, the disclosure of which is totally incorporated herein by reference, illustrates a liquid developer comprised of a nonpolar liquid, thermoplastic resin, optional colorant, and an alumina charge acceptance additive; U.S. Ser. No. 09/777,605 pending, filed concurrently herewith, the disclosure of which is totally incorporated herein by reference, illustrates a liquid developer comprised of a nonpolar liquid, resin, optional colorant, and an alkaline earth charge acceptance additive; U.S. Ser. No. 09/777,301 pending, filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the electrostatic latent image includes image areas of a first charge voltage and nonimage areas of a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of a cyclodextrin; and U.S. Ser. No. 09/777,968 pending, filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the electrostatic latent image includes image areas with a first charge voltage and nonimage areas with a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of an aluminum complex.

Illustrated in U.S. Pat. Nos. 6,180,308 and 6,218,066, the disclosures of each application being totally incorporated herein by reference, are developers with charge acceptance components and imaging processes thereof.

Illustrated in U.S. Pat. No. 5,627,002, the disclosure of which is totally incorporated herein by reference, is a positively charged liquid developer comprised of a nonpolar liquid, thermoplastic resin particles, pigment, a charge director, and a charge control agent comprised of a cyclodextrin or a cyclodextrin derivative containing one or more organic basic amino groups.

In U.S. Pat. No. 5,366,840 there are illustrated developers with aluminum complex components and which components may be selected as a charge acceptance additive for the developers of the present invention.

Disclosed in U.S. Pat. No. 5,826,147, the disclosure of which is totally incorporated herein by reference, is an electrostatic latent image development process wherein there is selected an imaging member with an imaging surface containing a layer of marking material and wherein imagewise charging can be accomplished with a wide beam ion source such that free mobile ions are introduced in the vicinity of an electrostatic image associated with the imaging member.

The appropriate components and processes of the above copending applications and patents may be selected for the present invention in embodiments thereof.

BACKGROUND OF THE INVENTION

This invention is generally directed to liquid developer compositions and processes thereof, and wherein there can be generated improved developed images thereof in bipolar ion charging processes, and reverse charge imaging and printing development (RCP) processes, reference U.S. Pat. No. 5,826,147, the disclosure of which is totally incorporated herein by reference, and wherein the developer contains no charge director, or wherein the developer contains substantially no charge director. More specifically, the liquid developer of the present invention is clear in color and is comprised of a resin, a hydrocarbon carrier, and as a charge acceptor a wax, especially a hydrocarbon wax, like a crystalline wax with, for example, from about 12 to about 40 and preferably from about 17 to about 25 carbons, and optional colorant.

The present invention is also specifically directed to a electrostatographic imaging process wherein an electrostatic latent image bearing member containing a layer of marking material, toner particles, or liquid developer as illustrated herein and containing a charge acceptance additive, which additive may be coated on the developer, is selectively charged in an imagewise manner to create a secondary latent image corresponding to the electrostatic latent image on the imaging member. Imagewise charging can be accomplished by a wide beam charge source for introducing free mobile charges or ions in the vicinity of the electrostatic latent image coated with the layer of marking material or toner particles. The latent image causes the free mobile charges or ions to flow in an imagewise ion stream corresponding to the latent image. These charges or ions, in turn, are accepted by the marking material or toner particles, leading to imagewise charging of the marking material or toner particles with the layer of marking material or toner particles itself becoming the latent image carrier. The latent image carrying toner layer is subsequently developed by selectively separating and transferring image areas of the toner layer to a copy substrate for producing an output document.

The present invention further relates to an imaging apparatus, wherein an electrostatic latent image including image and nonimage areas is formed in a layer of marking material, and further wherein the latent image can be developed by selectively separating portions of the latent image bearing layer of the marking material such that the image areas reside on a first surface and the nonimage areas reside on a second surface. In a simple embodiment, the invention can be defined as an image development apparatus comprising a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

The liquid developers and processes of the present invention possess a number of advantages including the development and generation of images with improved image quality, the avoidance of a charge director, the enablement of the developers in a reverse charging development process, excellent image transfer, enhancement of the charge on the developer solids of toner or resin, colorant, and wax, and the avoidance of complex chemical charging of the developer. Poor transfer can, for example, result in poor solid area coverage if insufficient toner is transferred to the final substrate and can also cause image defects such as smears and hollowed fine features. Conversely, over-charging the toner particles can result in low reflective optical density images or poor color richness or chroma since only a few very highly charged particles can discharge all the charge on the dielectric receptor causing too little toner to be deposited. To overcome or minimize such problems, the liquid toners, or developers and processes of the present invention were arrived at after extensive research. Other advantages are as illustrated herein and include minimal or no image blooming, the generation of excellent solid area images, minimal or no developed image character defects, and the like.

PRIOR ART

A latent electrostatic image can be developed with toner particles dispersed in an insulating nonpolar liquid. These dispersed materials are known as liquid toners or liquid developers. The latent electrostatic image may be generated by providing a photoconductive imaging member or layer with a uniform electrostatic charge, and developing the image with a liquid developer, or colored toner particles dispersed in a nonpolar liquid which generally has a high volume resistivity in excess of $10^9$ ohm-centimeters, a low dielectric constant, for example below about 3, and a moderate vapor pressure. Generally, the toner particles are less than about 30 $\mu$m (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid, alkyl esters, NUCREL® may be selected.

U.S. Pat. No. 5,030,535, the disclosure of which is totally incorporated herein by reference, discloses a liquid developer composition comprising a liquid vehicle, a charge additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429, the disclosure of which is totally incorporated herein by reference, there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Lithographic toners with cyclodextrins as antiprecipitants, and silver halide developers with cyclodextrins are known, reference U.S. Pat. Nos. 5,409,803, and 5,352,563, the disclosures of which are totally incorporated herein by reference.

Illustrated in U.S. Pat. No. 5,306,591, the disclosure of which is totally incorporated herein by reference, is a liquid developer comprised of a liquid component, thermoplastic resin, an ionic or zwitterionic charge director, or directors soluble in a nonpolar liquid; and a charge additive, or charge adjuvant comprised of an imine bisquinone; in U.S. Statutory Invention Registration No. H1483 there is described a liquid developer comprised of thermoplastic resin particles, and a charge director comprised of an ammonium AB diblock copolymer, and in U.S. Pat. No. 5,307,731 there is disclosed a liquid developer comprised of a liquid, thermoplastic resin particles, a nonpolar liquid soluble charge director, and a charge adjuvant comprised of a metal hydroxycarboxylic acid, the disclosures of each of these patents, and the Statutory Registration being totally incorporated herein by reference.

SUMMARY OF THE INVENTION

Examples of features of the present invention include:

It is a feature of the present invention to provide a liquid developer with many of the advantages illustrated herein.

Another feature of the present invention resides in the provision of a liquid developer capable of modulated particle charging with, for example, corona ions for image quality optimization.

It is a further feature of the invention to provide positively charged, and/or negatively charged liquid developers wherein waxes are selected as charge acceptance agents or charge acceptance additives, and wherein there can be an about 200 to about 500 percent increase in bipolar charging.

It is still a further feature of the invention to provide positively, and negatively charged liquid developers wherein developed image defects, such as smearing, loss of resolution and loss of density, and color shifts in prints having magenta images overlaid with yellow images, are eliminated or minimized.

Also, in another feature of the present invention there are provided positively charged liquid developers with certain charge acceptance agents that are in embodiments superior to liquid developers with no charge director in that they can be selected for RCP development, reference U.S. Pat. No. 5,826,147, the disclosure of which is totally incorporated herein by reference, and wherein there can be generated high quality images.

Furthermore, in another feature of the present invention there are provided liquid toners that enable excellent image characteristics, and which toners enhance the positive charge of the resin selected, such as NUCREL®, based resins.

These and other features of the present invention can be accomplished in embodiments by the provision of liquid developers.

Aspects of the present invention relate to a liquid developer comprised of a nonpolar liquid, thermoplastic resin, colorant, and a wax charge acceptance additive; a liquid developer wherein the wax charge acceptance additive is paraffin wax; a developer wherein the charge acceptance additive wax contains from about 17 to about 35 carbon atoms; a developer wherein the charge acceptance wax possesses an $M_w$ of from about 500 to about 1,000 and an $M_n$ of from about 250 to about 500; a liquid developer wherein the liquid has a viscosity of from about 0.5 to about 500 centipoise and a resistivity equal to or greater than about $5\times10^9$, and the thermoplastic resin possesses a volume average particle diameter of from about 0.1 to about 30 microns; a developer wherein the colorant is present in an amount of from about zero (0) to about 60 percent by weight based on the total weight of the developer solids; a developer wherein the colorant is carbon black, cyan, magenta, yellow, blue, green, orange, red, violet, brown or mixtures thereof; a developer wherein the charge acceptance additive is present in an amount of from about 0.05 to about 12 weight percent based on the weight of the developer solids of resin, colorant, and charge acceptance additive; a developer wherein the liquid for the developer is an aliphatic hydrocarbon; a developer wherein the aliphatic hydrocarbon is a mixture of branched hydrocarbons of from about 8 to about 16 carbon atoms, or a mixture of normal hydrocarbons of from about 8 to about 16 carbon atoms; a developer wherein the resin is an alkylene polymer, a styrene polymer, an acrylate polymer, a polyester, mixtures thereof or copolymers thereof; a developer wherein the developer further includes a charge adjuvant; a positively or negatively charged clear or slightly colored liquid developer comprised of a nonpolar liquid, a resin, and a charge acceptance wax additive; a developer further containing a colorant; a developer comprised of a liquid, thermoplastic resin, optional colorant, and a wax charge acceptance additive; a developer wherein the resin is poly(ethylene-co-methacrylic acid), poly(ethylene-co-acrylic acid), poly(propoxylated bisphenol) fumarate, or wherein the resin is alpha-olefin/vinyl alkanoate/methacrylic acid copolymers, alpha-olefin/acrylic acid copolymers, alpha-olefin/methacrylic acid copolymers, alpha-olefin/acrylate ester/methacrylic acid copolymers, alpha-olefin/methacrylate ester/methacrylic acid copolymers, copolymers of styrene/n-butyl acrylate or methacrylate/acrylic or methacrylic acid, and unsaturated ethoxylated or propoxylated bisphenol A fumarate polyesters; a developer comprised of from about 1 to about 20 percent solids of from about 5 to about 40 percent (weight percent) colorant, from about 0.05 to about 10 percent charge acceptance additive, and from about 30 to about 99.95 percent resin, and wherein the developer also contains from about 80 to about 99 percent of a nonpolar liquid; a developer comprised of from about 5 to about 15 percent by weight of toner solids comprised of from about 15 to about 55 weight percent of colorant, from about 0.05 to about 7 percent by weight of charge acceptance additive, and from about 38 to about 85 percent by weight of resin, and wherein the developer further contains from about 85 to about 95 percent by weight of a nonpolar liquid; a developer wherein the wax is a crystalline hydrocarbon wax; a liquid developer wherein the wax charge acceptance additive is polyethylene, polypropylene, or a polyethylene-polypropylene copolymer; a liquid developer wherein the wax charge acceptance additive is a n-paraffin wax of octodecane (C18 wax), nonadecane (C19 wax), eicosane (C20 wax), or triacontane (C30 wax); a liquid developer wherein the wax charge acceptance additive is linear low density polyethylene with a melting point of from about 80° C. to about 125° C.; a weight average molecular weight, $M_w$ of from about 2,000 to about 35,000 and a number average molecular weight, $M_n$ of from about 1,000 to about 6,000; a developer wherein the charge acceptance additive wax is a hydrocarbon wax containing from about 15 to about 50 carbon atoms; an RCP imaging apparatus containing the liquid developer illustrated herein, and wherein the developer is selectively charged to create a secondary latent image corresponding to a first latent image present on an imaging member; an imaging apparatus comprising a charging component, an imaging member, a developer component and a fuser component, and wherein the developer component contains the liquid developer illustrated herein; a xerographic imaging apparatus containing the liquid developers illustrated herein; and liquid developers comprised of a non-polar liquid, resin, preferably thermoplastic resin, and as a charge acceptor a hydrocarbon wax. In embodiments thereof of the present invention, the liquid developers can be charged in a device which first charges the developer to a first polarity, such as a positive polarity, followed by a second charging with a second charging device to reverse the developer charge polarity, such as to a negative polarity in an imagewise manner. Subsequently, a biased image (IB) separates the image from the background corresponding to the charged image pattern in the toner, or developer layer. Thus, the liquid developers can be charged by bipolar ion charging (BIC) rather than with chemical charging.

Hydrocarbon waxes are, for example, selected as the nonpolar medium insoluble charge acceptance agent, and which charge acceptance agent is capable of capturing either negative or positive ions to provide either negatively or positively charged liquid developers and preferably wherein the wax captures negative ions. Although not being desired to be limited by theory, it is believed that, for example, n-paraffin wax with a higher melting point than room temperature forms microcrystalline domains distributed in the liquid toner particles. Some microcrystallites are situated at or near the surface of toner particles, and at the surface of the microcrystallites, C—H bonds have an outward orientation. It is believed that the hydrogen end of the C—H bond having a slightly positive dipole moment tends to attract negative corona ions preferentially.

While not being desired to be limited by theory, although similar to the function of charge control agents in chemically charged liquid developers in that charge acceptance agents in ion-charged liquid developers are directly involved in charging liquid developers, capturing charge using a charge acceptance agent versus a charge control agent is different mechanistically. A first difference resides in the origin and location of the species reacting with a charge acceptance agent versus the origin and location of the species reacting with a charge control agent. The species reacting with a charge acceptance agent originate in the corona effluent, which after impinging on the toner layer, become trapped in the solid phase thereof. The species reacting with a charge control agent, for example the charge director, originates by purposeful formulation of the charge director into the liquid developer and this agent remains soluble in the liquid phase of the toner layer. Both the charge acceptance agent (in BIC-RCP developers) and the charge control additive or agent (in chemically charged developers) are usually insoluble in the liquid developer medium and reside on and in the toner particles, but charge directors, used in chemically charged developers, dissolve in the developer medium. A second difference between a charge acceptance agent and a charge control agent is that charge directors in chemically charged liquid developers charge toner particles to the desired polarity, while at the same time capturing the charge of opposite polarity so that charge neutrality is always maintained during this chemical equilibrium process. Charge separation occurs only later when the developer is placed in an electric field during development. In the BIC-RCP development process, the corona effluent used to charge the liquid developer is generated from a corona generating device and the dominant polarity of the effluent is fixed by the device. Corona ions first reach the surface of the toner layer, move through the liquid phase, and are adsorbed onto the particle and captured by the charge acceptance agent. The mobile or free corona ions in the liquid phase rapidly migrate to the ground plane. Some of these mobile ions may include counterions, if counterions are formed in the charging process. Counterions bear the opposite polarity charge versus the charged toner particles in the developer. The corona ions captured by the charge acceptance agent in or on the toner charge the developer to the same polarity as the dominant polarity charge in the corona effluent. The ion-charged liquid developer particles remain charged and most counterions, if formed in the process, exit to the ground plane so fewer counter charges remain in the developer layer. Electrical neutrality or equilibrium is not believed attained in the BIC-RCP development process and development is not interfered with by species containing counter charges.

The slightly soluble charge acceptance agent initially resides in the liquid phase but prior to charging the toner layer the charge acceptance agent deposits on the toner particle surfaces. The concentration of charge acceptor in the nonpolar solvent is believed to be close to the charge acceptor insolubility limit at ambient temperature especially in the presence of toner particles. The adsorption affinity between soluble charge acceptor and insoluble toner particles is believed to accelerate charge acceptor adsorption such that charge acceptor insolubility occurs at a lower charge acceptor concentration versus if toner particles were not present. When the insoluble or slightly soluble charge acceptors accept (chemically bind) ions from the impinging corona effluent (BIC) or from species derived therefrom, there is obtained a net charge on the toner particles in the liquid developer. Since the toner layer contains charge acceptors capable of capturing both positive and negative ions, the net charge on the toner layer is not determined by the charge acceptor but instead is determined by the predominant ion polarity emanating from the corona. Corona effluents rich in positive ions give rise to charge acceptor capture of more positive ions, and therefore provide a net positive charge to the toner layer. Corona effluents rich in negative ions give rise to charge acceptor capture of more negative ions, and therefore provide a net negative charge to the toner layer.

A difference in the charging mechanism of a charge acceptance agent versus a charge control agent indicates that after charging a liquid developer via the standard charge director (chemical charging) mechanism, the developer contained an equal number of charges of both polarity. An equal number of charges of both polarities in the developer hinders reverse charge imaging, so adding a charge director to the developer before depositing the so-called uncharged developer onto the dielectric surface is undesirable. However, if corona ions in the absence of a charge director are used to charge the toner layer, the dominant ion polarity in the effluent will be accepted by the toner particles to a greater extent resulting in a net toner charge of the desired polarity and little if any counter-charged particles. When the toner layer on the dielectric receiver has more of one kind (positive or negative) of charge on it, reverse charge imaging is facilitated.

Examples of charge acceptance additives present in various effective amounts of, for example, from about 0.001 to about 15, and more specifically, from about 0.01 to about 7 weight percent or parts, include waxes, such as hydrocarbon waxes, like n-paraffin waxes, polyethylene, polypropylene, polyethylene-polypropylene copolymer, Petrolite Unilins and Unithox waxes. Examples of n-paraffin wax are octodecane (C18 wax), nonadecane (C19 wax), eicosane (C20 wax), and triacontane (C30 wax). Examples of polyethylene waxes are linear low density polyethylenes possessing a melting point range of, for example, about 80° C. to about 125° C. with, for example, $M_w$ ranges of about 2,000 to about 35,000 and $M_n$ ranges of about 1,000 to about 6,000. The waxes of Konica U.S. Pat. Nos. 4,917,982; 4,921,771; 4,988,598; 4,997,739; 5,004,666 and 5,023,158, the disclosures of which are totally incorporated herein by reference, can be selected for the developers of the present invention in embodiments thereof.

In embodiments of the present invention, the wax charge acceptance agents are selected in various effective amounts, such as for example from about 0.01 to about 10, and preferably from about 1 to about 7 weight percent based on the total weight percent of the resin solids, other charge additives, colorants, and wax, and wherein the total of all solids is about 1 to about 20 percent and the total of nonpolar liquid carriers is about 80 to about 99 percent based on the weight of the total liquid developer. The toner solids contain, for example, about 1 to about 7 percent wax, about 15 to about 60 percent colorant, about 33 to about 83 percent resin.

Of importance with respect to the present invention in embodiments thereof is the presence in the liquid developer of the wax charge acceptor which function to, for example, increase the Q/M of both positive and negatively charged developers. The captured charge, Q=fCV where C is the capacitance of the toner layer, V is the measured surface voltage, and f is a proportionality constant which is dependent upon the distribution of captured charge in the toner layer. M in Q/M is the total mass of the toner solids. It is believed that all charges are associated with toner particles.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than, for example, $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR Me has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10_9$ ohm-centimeters and a dielectric constant below 3 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 80 to about 99 percent, and more specifically, from about 85 to about 95 percent by weight of the total liquid developer. The term dispersion is used to refer to the complete process of incorporating a fine particle into a liquid medium such that the final product consists of fine toner particles distributed throughout the medium. Since liquid developer consists of fine particles dispersed in a nonpolar liquid, it is often referred to as dispersion. The liquid developer dispersion consists of fine toner particles, here referred to as toner solids, and nonpolar liquid. However, other effective amounts may be selected. The total solids which include resin, other charge additives such as adjuvants, optional colorants, and the cyclodextrin or aluminum complex charge acceptance agent, content of the developer in embodiments is, for example, 0.1 to 20 percent by weight, preferably from about 3 to about 17 percent, and more preferably, from about 5 to about 15 percent by weight.

Typical suitable thermoplastic toner resins can be selected for the liquid developers of the present invention in effective amounts, for example, in the range of about 99.9 percent to about 40 percent, and preferably 80 percent to 50 percent of developer solids comprised of thermoplastic resin, charge acceptance component, and charge additive, and in embodiments other components that may comprise the toner. Generally, developer solids include the thermoplastic resin, charge additive, and charge acceptance agent. Examples of resins include ethylene vinyl acetate (EVA) copolymers (ELVAX® resins, E.I. DuPont de Nemours and Company, Wilmington, Del. ); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof.

The liquid developers of the present invention can contain a colorant, for example, dispersed in the resin particles. Colorants, such as pigments or dyes and mixtures thereof, may be present to render the latent image visible.

The colorant may be present in the developer in a suitable amount of, for example, from about 0.1 to about 60 percent, and preferably from about 15 to about 60, and in embodiments about 25 to about 45 percent by weight based on the total weight of solids contained in the developer. The amount of colorant used may vary depending on the use of the developer. Examples of pigments which may be selected include carbon blacks available from, for example, Cabot Corporation, FANAL PINK™, PV FAST BLUE™, pigments as illustrated in U.S. Pat. No. 5,223,368, the disclosure of which is totally incorporated herein by reference; other known pigments; and the like. Dyes are known and include food dyes.

To further increase the toner particle charge and, accordingly, increase the transfer latitude of the toner particles, charge adjuvants can be added to the developer. For example, adjuvants, such as metallic soaps like magnesium stearate or octoate, fine particle size oxides, such as oxides of silica, alumina, titania, and the like, paratoluene sulfonic acid, and polyphosphoric acid, may be added. These types of adjuvants can assist in enabling improved toner charging characteristics, namely, an increase in particle charge that results in improved image development and transfer to allow superior image quality with improved solid area coverage and resolution in embodiments. The adjuvants can be added to the developer in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes, such as, for example, mixing in a nonpolar liquid the thermoplastic resin, wax charge acceptance component, other charge additives, such as charge adjuvants and colorant, followed by heating the mixture to a temperature of from about 40° C. to about 110° C. until a uniform dispersion is formed; adding an additional amount of nonpolar liquid sufficient to decrease the total solids concentration of the developer to about 10 to about 30 percent by weight solids and isolating the developer by, for example, cooling the dispersion to about 10° C. to about 30° C. In the initial mixture, the resin, charge acceptance component, optional colorant and charge acceptance additive may be added separately to an appropriate vessel such as, for example, an attritor, heated ball mill, heated vibratory mill, such as a Sweco Mill manufactured by Sweco Company, Los Angeles, Claif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60, and more specifically, from about 35 to about 45 percent solids. This mixture is then subjected to elevated temperatures during the initial mixing procedure to plasticize and soften the resin. The mixture is sufficiently heated to provide a uniform dispersion of all the solid materials of, for example, optional colorant, cyclodextrin charge acceptance component, charge acceptance agent, and resin. However, the temperature at which this step is undertaken should not be so high as to degrade the nonpolar liquid or decompose the resin or colorant if present. Accordingly, the mixture in embodiments is heated to a temperature of from about 50° C. to about 110° C., and preferably from about 50° C. to about 80° C. The mixture may be ground in a heated ball mill or heated attritor at this temperature for about 15 minutes to about 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 30 percent by weight.

The dispersion is then cooled to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods, such as the use of a cooling fluid like water, glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to about 36 hours, and preferably from about 2 to about 4 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778, and 4,783,389, the disclosures of which are totally incorporated herein by reference.

As illustrated herein, the developers or inks of the present invention can be selected for RCP imaging and printing methods wherein, for example, there can be selected an imaging apparatus, wherein an electrostatic latent image including image and nonimage areas is formed in a layer of marking material, and further wherein the latent image can be developed by selectively separating portions of the latent image bearing layer of the marking material such that the image areas reside on a first surface and the nonimage areas reside on a second surface. In an embodiment, the invention is directed to an image development apparatus, comprising a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

Embodiments of the invention will be illustrated in the following nonlimiting Examples, it being understood that these Examples are intended to be illustrative only, and that the invention is not intended to be limited to the materials, conditions, process parameters and the like recited. The toner particles in the liquid developer can range in diameter size of from 0.1 to 3 micrometers with the preferred particle size range being about 0.5 to 1.5 micrometers. Particle size, when measured, was measured by a Horiba CAPA-700 centrifugal automatic particle analyzer manufactured by Horiba Instruments, Inc., Irvine, Calif.

EXAMPLES

Control in Table 1=100 Percent of DuPont RX-76®; No Charge Acceptance Agent:

Two hundred seventy (270) grams of NUCREL RX-76® (a copolymer of ethylene and methacrylic acid with a melt index of about 800, available from E.I. DuPont de Nemours & Company, Wilmington, Del.), and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture resulting was milled in the attritor, which was heated with running steam through the attritor jacket to 80° C. to 115° C. for 2 hours. 675 Grams of ISOPAR-M® were then added to the attritor at the conclusion of 2 hours, and the mixture was then cooled to 23° C. by running water through the attritor jacket. The contents of the attritor were ground for an additional 4 hours. Additional ISOPAR-M®, about 900 grams, was added and the mixture resulting was separated from the steel balls.

The liquid developer solids contained 100 percent NUCREL RX-76® toner resin. The solids level was 10.067 percent and the ISOPAR M® level was 89.933 percent of this liquid developer. The liquid developer was used as is.

Example I in Table 1=95 Percent of DuPont RX-76®; 5 Percent C20 Wax Charge Acceptance Agent:

Two hundred fifty six point five (256.5) grams of NUCREL RX-76® (a copolymer of ethylene and methacrylic acid with a melt index of about 800, available from E.I. DuPont de Nemours & Company, Wilmington, Del.), 13.5 grams of the C20 (with 20 carbons) wax n-eicosane (available from Aldrich 21,927-4) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to 80° C. to 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 95 percent NUCREL RX-76® toner resin and 5 percent C20

(n-eicosane) wax charge acceptance agent. The solids level was 10.368 percent and the ISOPAR M® level was 89.632 percent of this liquid developer. The liquid developer was used as is.

CHARGING VOLTAGE TEST RESULTS

To further illustrate the effect of the charge acceptor on RCP ink charging, a toner layer surface-charging voltage test can be employed, reference for example U.S. Ser. No. 492,706, and U.S. Ser. No. 492,707, the disclosures of each application being totally incorporated herein by reference.

TABLE 1

| | Ink Composition | | | | | Test Results* | | | |
|---|---|---|---|---|---|---|---|---|---|
| | | | | | | Positive Charging | | Negative Charging | |
| | Solid Phase | | | Liquid Phase | | | | | |
| | Resin | Pigment | Charge Acceptance Agent | Carrier fluid | Charge director | Initial Surface Voltage | Surface Voltage after 5 seconds | Initial Surface Voltage | Surface Voltage after 5 seconds |
| Control | 100% Nucrel RX-76 | No | No | Isopar M | No | 91 | 54 | −49 | −24 |
| Example I | 95% Nucrel RX-76 | No | 5% C20 Wax | Isopar M | No | 99 | 47 | −144 | −69 |

*All tests were carried out using +250 V and −250 V scorotron grid voltages for + and − charging, respectively.

Ink (toner) layers with thicknesses of about 15 $\mu$m were generated by draw bar coating. Scorotrons were used as charging and recharging devices.

The positive and negative toner layer charge-capturing propensity can be measured by several techniques. One of the most frequently used techniques involves first charging the toner layer with a scorotron for a fixed time, e.g. 2 seconds, and then monitoring the surface voltage decay as a function of time as soon as charging is turned off. This is done for both positively and negatively charged toner layers.

The data in the Control of Table 1 indicate that the ink layer with no charge acceptor captured or accepted negative charge equivalent to a surface voltage of −49 volts and decayed to −24 volts thereof in 5 seconds. However, the same ink layer, when charged positively, captured or accepted +91 volts initially, but then the voltage of this control ink layer decayed to +54 volts in 5 seconds.

The data in Example I of Table 1, wherein 5 weight percent C20 wax was used as the charge acceptance agent, indicate that the ink layer, when charged negatively, captured or accepted negative charge equivalent to a surface voltage of −144 volts and maintained −69 volts thereof for 5 seconds. When charged positively, the same ink layer captured or accepted +99 volts and decayed slowly to +47 volts in 5 seconds. When charged negatively, the ink layer containing the 5 weight percent C20 wax charge acceptance agent improved (versus the control without wax) in negative charging level from −49 volts to −144 volts (294 percent improvement). Comparing the decay for the 5 second negative surface voltage in Example I versus the Control indicates that in Example I the 5 second negative surface voltage was −68 volts (288 percent improvement) whereas in the Control the 5 second negative surface voltage was −24 volts. When charged positively, the ink layer containing the 5 weight percent C20 wax charge acceptance agent showed similar positive charging level for both control without and the sample with 5 percent C20 wax. Comparing the decay for the 5 second positive surface voltage in Example I versus the Control indicates that in Example I the 5 second positive surface voltage was about the same as in the Control. Although the C20 wax did not alter the positive charging propensity significantly, it improved the negative charging by about 290 percent. Also, the wax additive is suitable for use as a negative charge acceptance agent.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of a nonpolar liquid, thermoplastic resin, colorant, and a wax charge acceptance additive, and wherein said charge acceptance additive functions to capture positive ions or negative ions to provide a positively charged liquid developer or a negatively charged liquid developer respectively.

2. A liquid developer in accordance with claim 1 wherein said wax charge acceptance additive is paraffin wax.

3. A developer in accordance with claim 1 wherein said charge acceptance additive wax contains from about 17 to about 35 carbon atoms.

4. A developer in accordance with claim 1 wherein said charge acceptance wax possesses an $M_w$ of from about 500 to about 1,000 and an $M_n$ of from about 250 to about 500.

5. A liquid developer in accordance with claim 1 wherein said liquid has a viscosity of from about 0.5 to about 500 centipoise and a resistivity equal to or greater than about $5\times10^9$, and said thermoplastic resin possesses a volume average particle diameter of from about 0.1 to about 30 microns.

6. A developer in accordance with claim 1 wherein the colorant is present in an amount of from about zero (0) to about 60 percent by weight based on the total weight of the developer solids.

7. A developer in accordance with claim 1 wherein the colorant is carbon black, cyan, magenta, yellow, blue, green, orange, red, violet, brown or mixtures thereof.

8. A developer in accordance with claim 1 wherein the charge acceptance additive is present in an amount of from about 0.05 to about 12 weight percent based on the weight of the developer solids of resin, colorant, and charge acceptance additive.

9. A developer in accordance with claim 1 wherein the liquid for said developer is an aliphatic hydrocarbon.

10. A developer in accordance with claim 9 wherein the aliphatic hydrocarbon is a mixture of branched hydrocarbons of from about 8 to about 16 carbon atoms, or a mixture of normal hydrocarbons of from about 8 to about 16 carbon atoms.

11. A developer in accordance with claim 1 wherein the resin is an alkylene polymer, a styrene polymer, an acrylate polymer, a polyester, mixtures thereof or copolymers thereof.

12. A developer in accordance with claim 1 wherein said developer further includes a charge adjuvant.

13. A positively or negatively charged clear or slightly colored liquid developer comprised of a nonpolar liquid, a resin, and a charge acceptance wax additive.

14. A developer in accordance with claim 13 further containing a colorant.

15. A developer comprised of a liquid, thermoplastic resin, optional colorant, and a wax charge acceptance additive, and wherein said charge acceptance additive functions to capture positive ions or negative ions to provide a positively charged liquid developer or a negatively charged liquid developer respectively.

16. A developer in accordance with claim 1 wherein the resin is poly(ethylene-co-methacrylic acid), poly(ethylene-co-acrylic acid), poly(propoxylated bisphenol) fumarate, or wherein said resin is alpha-olefin/vinyl alkanoate/methacrylic acid copolymers, alpha-olefin/acrylic acid copolymers, alpha-olefin/methacrylic acid copolymers, alpha-olefin/acrylate ester/methacrylic acid copolymers, alpha-olefin/methacrylate ester/methacrylic acid copolymers, copolymers of styrene/n-butyl acrylate or methacrylate/acrylic or methacrylic acid, and unsaturated ethoxylated or propoxylated bisphenol A fumarate polyesters.

17. A developer in accordance with claim 1 comprised of from about 1 to about 20 percent solids of from about 5 to about 40 percent colorant, from about 0.05 to about 10 percent charge acceptance additive, and from about 30 to about 99.95 percent resin, and wherein the developer also contains from about 80 to about 99 percent of a nonpolar liquid.

18. A developer in accordance with claim 1 comprised of from about 5 to about 15 percent by weight of toner solids comprised of from about 15 to about 55 weight percent of colorant, from about 0.05 to about 7 percent by weight of charge acceptance additive, and from about 38 to about 85 percent by weight of resin, and wherein the developer further contains from about 85 to about 95 percent by weight of a nonpolar liquid.

19. A developer in accordance with claim 1 wherein said wax is a crystalline hydrocarbon wax.

20. A liquid developer in accordance with claim 1 wherein said wax charge acceptance additive is polyethylene, polypropylene, or a polyethylene-polypropylene copolymer.

21. A liquid developer in accordance with claim 1 wherein said wax charge acceptance additive is a n-paraffin wax of octodecane (C18 wax), nonadecane (C19 wax), eicosane (C20 wax), or triacontane (C30 wax).

22. A liquid developer in accordance with claim 1 wherein said wax charge acceptance additive is linear low density polyethylene with a melting point of from about 80° C. to about 125° C.; a weight average molecular weight, $M_w$ of from about 2,000 to about 35,000 and a number average molecular weight, $M_n$ of from about 1,000 to about 6,000.

23. A developer in accordance with claim 1 wherein said charge acceptance additive wax is a hydrocarbon wax containing from about 15 to about 50 carbon atoms.

24. An RCP imaging apparatus containing the liquid developer of claim 1, and wherein said developer is selectively charged to create a secondary latent image corresponding to a first latent image present on an imaging member.

25. An imaging apparatus comprising a charging component, an imaging member, a developer component and a fuser component, and wherein said developer component contains the liquid developer of claim 1.

26. An imaging apparatus in accordance with claim 25 wherein said apparatus is a xerographic apparatus.

27. A liquid developer in accordance with claim 1 wherein said wax forms microcrystalline domains distributed in said liquid developer, and wherein said microcrystallite is situated at or near the surface thereof.

28. A liquid developer in accordance with claim 1 wherein said charge acceptance component initially resides in the liquid phase, and wherein prior to charging the developer layer, the acceptance component deposits on the toner particle surfaces.

* * * * *